US007171810B2

(12) United States Patent
Conrad

(10) Patent No.: US 7,171,810 B2
(45) Date of Patent: Feb. 6, 2007

(54) STIRLING ENGINE WITH HYDRAULIC OUTPUT

(75) Inventor: Wayne Ernest Conrad, Hampton (CA)

(73) Assignee: GBD Corporation, Nassau (BS)

( * ) Notice: Subject to any disclaimer, the term of this patent is extended or adjusted under 35 U.S.C. 154(b) by 104 days.

(21) Appl. No.: 10/506,499

(22) PCT Filed: Mar. 7, 2002

(86) PCT No.: PCT/CA02/00290

§ 371 (c)(1),
(2), (4) Date: Sep. 3, 2004

(87) PCT Pub. No.: WO02/070887

PCT Pub. Date: Sep. 12, 2002

(65) Prior Publication Data

US 2005/0115242 A1 Jun. 2, 2005

(51) Int. Cl.
*F01B 29/10* (2006.01)

(52) U.S. Cl. ..... 60/517; 60/520

(58) Field of Classification Search ..... 60/517, 60/518, 520, 524, 526
See application file for complete search history.

(56) References Cited

U.S. PATENT DOCUMENTS

| | | | | | |
|---|---|---|---|---|---|
| RE30,176 | E | * | 12/1979 | Beale | 60/520 |
| 4,488,853 | A | * | 12/1984 | Benson | 417/240 |
| 4,489,554 | A | * | 12/1984 | Otters | 60/518 |
| 4,638,633 | A | * | 1/1987 | Otters | 60/518 |
| 4,723,410 | A | * | 2/1988 | Otters | 60/518 |
| 4,747,271 | A | * | 5/1988 | Fischer | 60/670 |
| 6,305,159 | B1 | * | 10/2001 | Nagel | 60/39.6 |
| 6,470,677 | B2 | * | 10/2002 | Bailey | 60/418 |

FOREIGN PATENT DOCUMENTS

GB 1581748 * 12/1980

* cited by examiner

*Primary Examiner*—Hoang Nguyen
(74) *Attorney, Agent, or Firm*—Philip C. Mendes da Costa; Bereskin & Parr

(57) ABSTRACT

A heat engine has a region within which a working fluid travels and an hydraulic fluid provided in a reservoir and the output from the heat engine drives the movement of the hydraulic fluid.

18 Claims, 4 Drawing Sheets

STIRLING ENGINE WITH HYDRAULIC OUTPUT

FIELD OF THE INVENTION

This invention relates to a new and improved linear hydraulic drive system for use with a Stirling engine.

BACKGROUND PRIOR ART

Resonant free piston Stirling engine systems are known in the art wherein the load apparatus is hydraulically driven from the periodic pressure wave of the engine. In such known systems the load apparatus is typically disposed within an incompressible fluid-filled space between a pair of flexible diaphragms which seal in and isolate the incompressible fluid, referred to herein as "hydraulic fluid", from the Stirling Engine. One of the diaphragms is arranged to be acted on by the resulting pressure wave produced in the hydraulic oil and the other diaphragm is arranged as part of a gas spring. The pressure waves produced in the hydraulic oil are operative to reciprocally drive the movable member of the load apparatus in a direction along the same axis as that of the Stirling Engine. Such prior art engine-driven system assemblies were arranged in a stacked, coaxial relationship. While generally satisfactory, the diaphragms employed dramatically limited the useful life of such a device before maintenance was required. Other prior art arrangements had the load components immersed in the hydraulic oil making maintenance, service and repair difficult and expensive.

SUMMARY OF THE INVENTION

The hydraulic drive system of the instant invention is arranged and constructed to operate from the periodic pressure wave of the Stirling engine to pump the hydraulic fluid through a loop wherein a piston or motor drive is deployed to covert the hydraulic fluid flow to linear or rotary motion. In one embodiment, the hydraulic fluid is acted upon directly by the periodic pressure wave produced by the Stirling Engine. Alternately, the heat engine or Stirling engine may produce mechanical or electrical power that is used to power the hydraulic output system.

While the new and improved hydraulic power output and pump system of this invention is capable of use with a Stirling engine, it can be equally well applied in systems wherein fuel explosions or other periodic pressure pulses are available to provide the motive force. Also, while the invention will generally be described in connection with a hydraulic motor, it is understood that the invention could also be applied to compressors, pumps, pistons, linear alternators, and other like load apparatus.

In accordance with the instant invention, there is provided a new and improved hydraulic drive system for use with a Stirling engine which reduces the length of the engine-drive assembly.

In accordance with the instant invention, there is also provided a hydraulic drive system for use with a Stirling engine wherein the hydraulic oil is positively displaced so as to provide compact, light-weight drive means consisting of few components which can directly provide power to conventional pistons, hydraulic motors, or other like loads.

In accordance with the instant invention, there is also provided a hydraulic drive system for use with a Stirling engine which can be readily pressurized to 100 atm for use with a Stirling engine similarly pressurized so as to provide a very high specific power per unit weight and per unit volume in a compact, light-weight drive means.

BRIEF DESCRIPTION OF THE DRAWINGS

These and other advantages of the instant invention will be more fully and particularly understood in connection with the following description of the preferred embodiments of the invention in which.

DESCRIPTION OF THE PREFERRED EMBODIMENT

Figure 1:
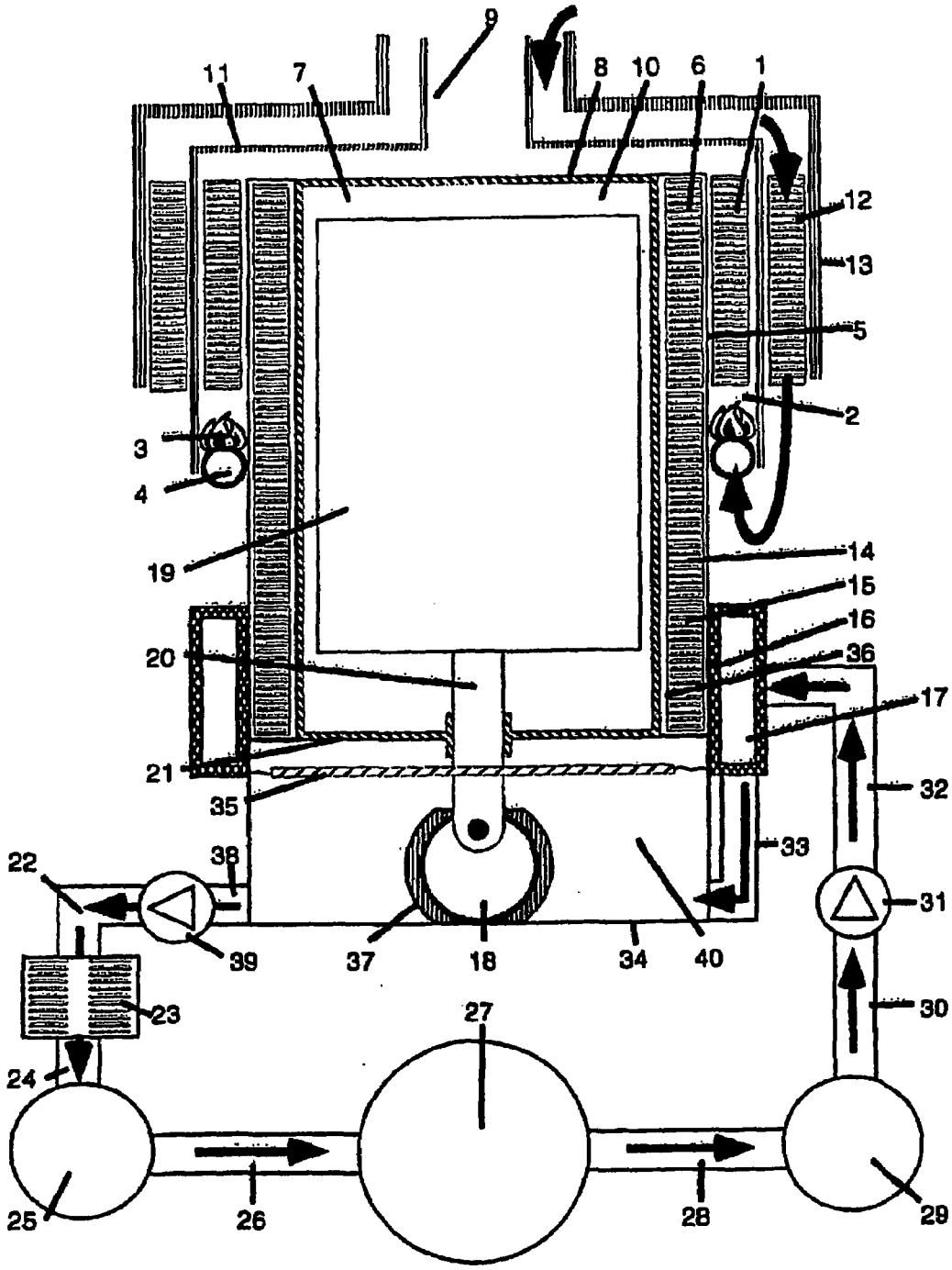
FIG. 1 is a cross section of a heat engine and a hydraulic drive system according to the instant invention.

The preferred embodiment of the invention is shown in FIG. 1. A shroud 11 covers a series of louvred fins 1 which transfer heat from the hot combustion gasses 2 to the heat engine wall 5 and into the louvred fins 6 within the engine which in turn transfer the heat to the working fluid 7. In addition, the hot combustion gasses 2 transfer heat to the upper end-cap 8 which in turn transfers this heat to the working fluid 7 within the engine. The hot combustion gasses are produced by the flame 3 which is fed by the gas ring burner 4. The hot combustion gasses exit the system through the chimney 9. In addition, radiation transfers heat from the flame 3 to the louvred fins 1. The shroud 11 is supported by a series of louvred fins 12 which are in turn supported by an outer cover 13. The louvred fins 12 act as a pre-heater for the combustion gasses thereby improving the burner efficiency and also act to support the heated section of the heat engine wall 5 which is weakened due to its heating. The outer cover 13 is substantially colder than the heat engine wall 5 and the louvred fins 12 and 1 serve to mechanically translate the support offered by the outer cover 13 to the heat engine wall 5. Thus, a cooler metal serves to support the hotter wall. The louvred fins 14 serve as the regenerator section of the heat engine while the louvred fins 15 serve to remove heat from the working fluid and transfer it through the cold section of the heat engine wall 16 and into the hydraulic fluid 40. It will be appreciated that other construction for a heat engine may be used with the hydraulic drive described hereafter.

The displacer 19 is supported by a shaft 20 which is supported by member 21 and is attached to an eccentric drive 18 which is mounted on an electric motor 37 which is immersed in the hydraulic fluid 40 within the main pump chamber 34 whereby eliminating the need for a pressure seal within the displacer drive system.

When the engine is hot and the displacer 19 moves to its bottom dead centre position the working fluid 7 expands thereby exerting pressure on the hydraulic fluid 40 within the main pump chamber 34. The hydraulic fluid 40 begins to flow in response to this pressure. The hydraulic fluid 40 flows through the pipe 38 through the one way check valve 39 through pipe 22 through the heat exchanger 23 through pipe 24 into accumulator 25 through pipe 26 and through the motor 27 (which provides useful work—i.e. the output to a load) through pipe 28 into accumulator 29 through pipe 30 through check valve 31 through pipe 32 through the cooling section 17 and through pipe 33 back into the main pump chamber 34.

The accumulator 29 maintains a pressure greater than the engine buffer pressure so that when the displacer travels to the top dead centre and the pressure within the engine is reduced to the buffer pressure, the hydraulic fluid 20 can flow through pipe 30 through check valve 31 through pipe 32 through the cooling section 17 and through pipe 33 back into the main pump chamber 34 to refill the main pump chamber 34 in preparation for the next cycle. The size of the reservoirs 25 and 29 and of the entire hydraulic piping must be sufficient to allow the rate of flow required to deliver the power output from the engine to the motor 27. One major advantage of this system is that the accumulators 25 and 29 and the working fluid 7 can all be pre-pressurized to a high pressure thereby yielding a very high specific power output for a small engine. The hydraulic fluid may be an oil or an aqueous fluid. If the hydraulic fluid is an oil, then the preferred hydraulic oil is silicone oil. If the hydraulic fluid is aqueous, then the preferred hydraulic fluid comprises water, an antifreeze and a corrosion inhibitor. In some applications, the aqueous hydraulic fluid may be buffered.

Optional floating splash guard 35 minimizes splash within the engine. The member 21 also serves to trap a small amount of gas in a head space above the hydraulic fluid thereby ensuring that the fluid level can never rise above member 21. Alternatively, a float mechanism may be employed to limit the amount of hydraulic fluid which will flow in during the refilling cycle although the buffer pressure should control this as well.

Figure 2:
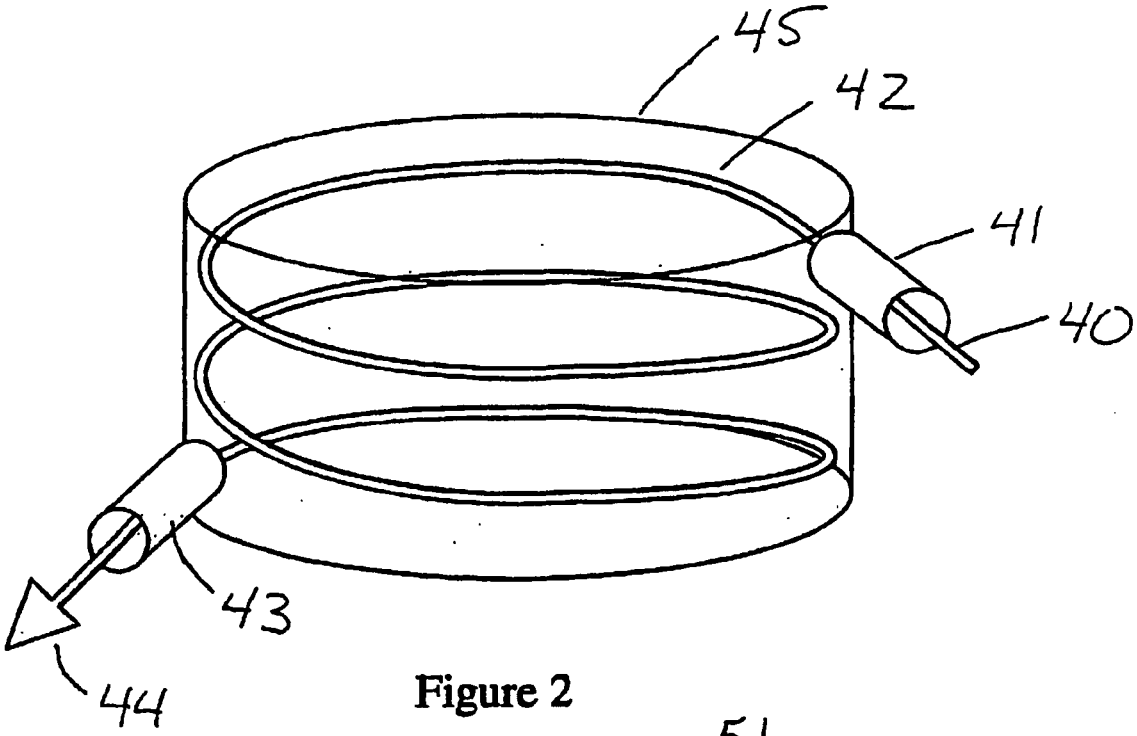
FIG. 2 is a three dimension sketch of a hydraulic pump to be driven by a periodic pressure pulse source such as a Stirling engine wherein the pump employs a tangential inflow and a tangential outflow design.

An embodiment for the hydraulic pump to be driven by a periodic pressure pulse source such as a Stirling engine wherein the hydraulic pump employs a tangential inflow and a tangential outflow design is shown in FIG. 2. In this embodiment the fluid to be pumped 40 enters the pump housing 45 through tangential inlet 41 and follows a spiral path 42 to the tangential outlet 43 where the fluid 44 exits the pump. A check valve (not shown) may be used at one or both of the inlet 41 and the outlet 44 to maintain unidirectional flow within the pump.

Figure 3:
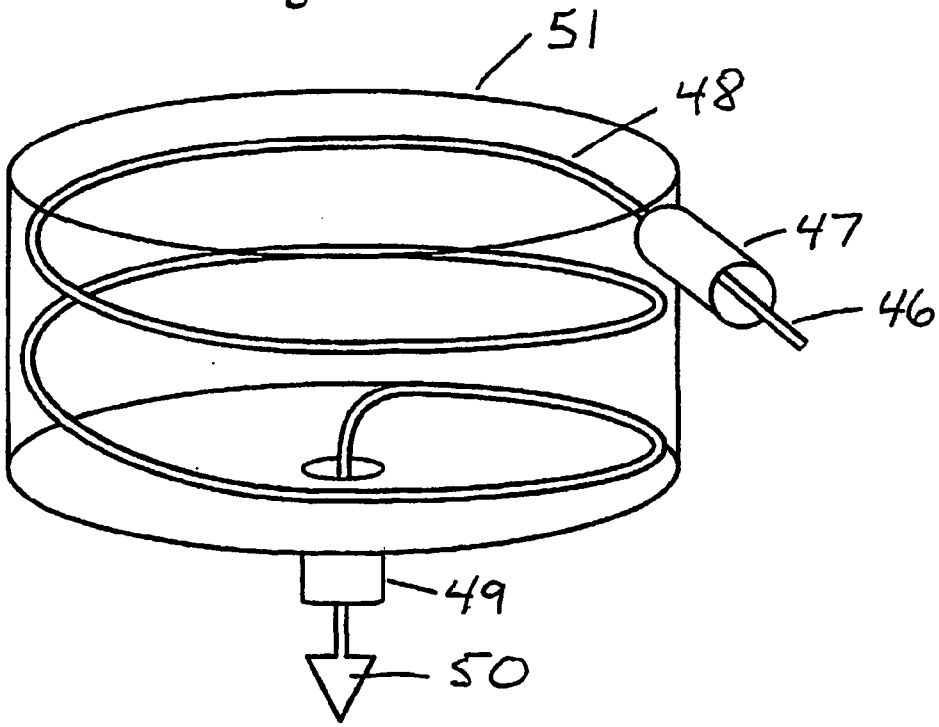
FIG. 3 is a three dimension sketch of a hydraulic pump to be driven by a periodic pressure pulse source such as a Stirling engine wherein the pump employs a tangential inflow and bottom outflow design.

An embodiment for the hydraulic pump to be driven by a periodic pressure pulse source such as a Stirling engine wherein the hydraulic pump employs a tangential inflow and an axial outflow design is shown in FIG. 3. In this embodiment the fluid to be pumped 46 enters the pump housing 51 through tangential inlet 47 and follows a spiral path 48 to the bottom outlet 49 where the fluid 50 exits the pump. A check valve (not shown) may be used at one or both of the inlet 47 and the outlet 49 to maintain unidirectional flow within the pump.

Figure 4:
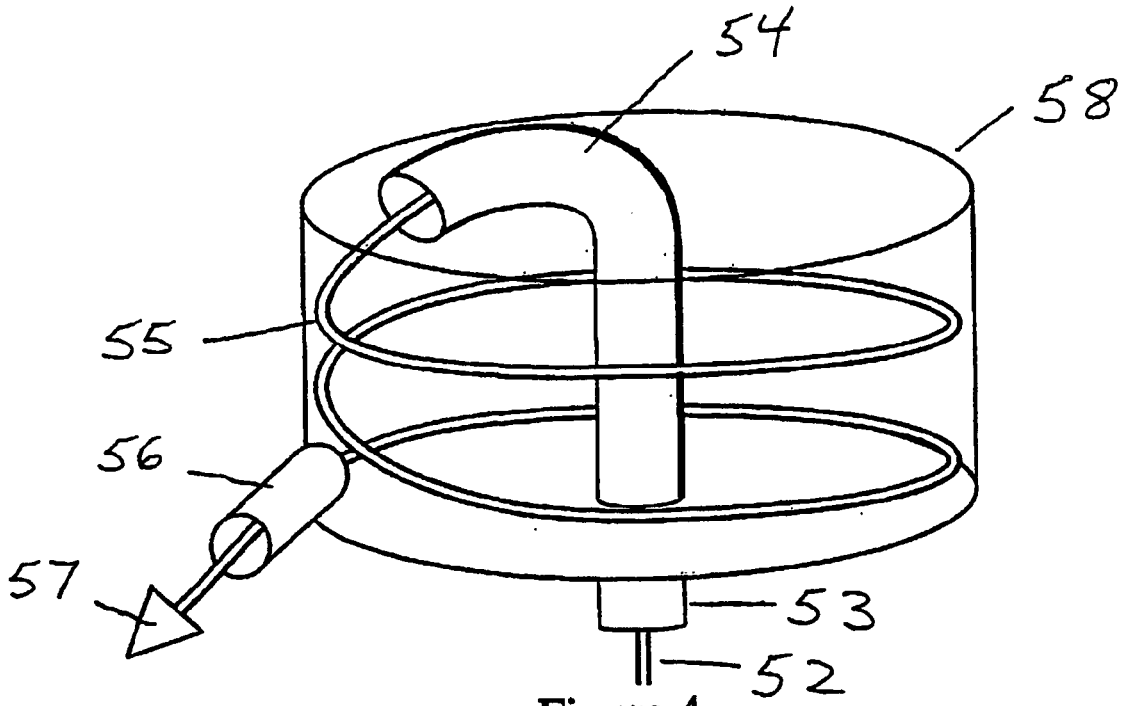
FIG. 4 is a three dimension sketch of a hydraulic pump to be driven by a periodic pressure pulse source such as a Stirling engine wherein the pump employs a bottom inlet through a three dimension elbow and a tangential outflow design; and, FIG. 5 is a schematic drawing of an alternate embosiment of a heat engine and a hydraulic drive system according to the instant invention

An embodiment for the hydraulic pump to be driven by a periodic pressure pulse source such as a Stirling engine wherein the hydraulic pump employs an axial inflow and a tangential outflow design is shown in FIG. 4. In this embodiment the fluid to be pumped 52 enters the pump housing 58 through a bottom inlet 53 and through a three dimensional elbow 54 which sets the flow onto a spiral path 55 to the tangential outlet 56 where the fluid 57 exits the pump. A check valve (not shown) may be used at one or both of the inlet 53 and the outlet 56 to maintain unidirectional flow within the pump.

Figure 5:
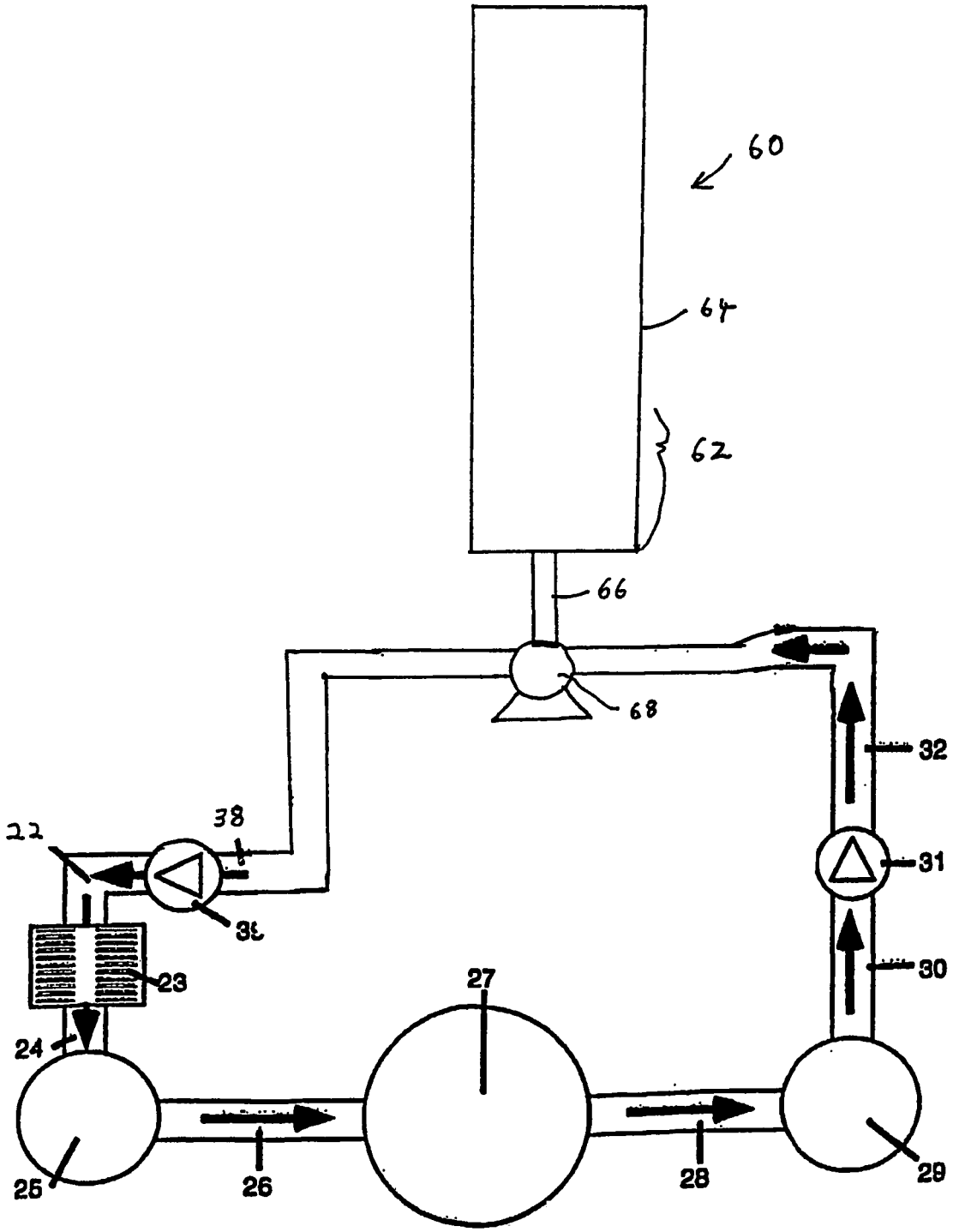

In the alternate embodiment of FIG. 5, a hydraulic power deliver system utilizes mechanical energy output from a heat engine. As shown therein, a heat engine 60, which may the same or different to the heat engine shown in FIG. 1, has a linear to rotary converter. Linear to a rotary converter may be provided integrally with heat engine 60. For example, as shown in FIG. 5, linear to rotary converter is designated by reference numeral 62 and is enclosed in container 64 which may be the outer shell of heat engine 60. Mechanical energy from linear to rotary converter 62 is supplied by output shaft 66 which is drivingly connected to pump 68. Output shaft may be directly drivingly coupled to pump 68 or, alternately, it may be indirectly coupled such as through a transmission or other power regulation means. In a further alternate embodiment, heat engine 60 may include a linear generator (e.g. the power piston of heat engine 60 may comprise a portion of a linear generator). In such a case, heat engine 60 would produce electricity which could be used to power pump 68.

I claim:

1. A Stirling engine having a region within which a working fluid travels and an output system including a chamber having a liquid inlet connectable to a first conduit and a liquid outlet connectable to a second conduit, whereby, the chamber, the first conduit and the second conduit define a circuit for a liquid and the Stirling engine produces power which is used to cause the liquid to flow through the circuit and to perform work on a member external to the Stirling engine as the fluid flows through the circuit.

2. The Stirling engine as claimed in claim 1 wherein the chamber is open to the region within which a working fluid travels whereby the working fluid directly contacts the liquid to pump the liquid.

3. The Stirling engine as claimed in claim 1 wherein the liquid is silicone oil.

4. The Stirling engine as claimed in claim 1 wherein the flow of liquid into and out from the reservoir is tangential.

5. The Stirling engine as claimed in claim 1 wherein the chamber is a liquid reservoir and the flow of liquid into the reservoir is tangential and the flow of liquid out from the reservoir is axial.

6. The Stirling engine as claimed in claim 1 wherein the chamber is a liquid reservoir and the flow of liquid into the reservoir is axial and the flow of liquid out from the reservoir is tangential.

7. The Stirling engine as claimed in claim 1 wherein the chamber is a liquid reservoir, the liquid travels in a circuit and the working fluid and the liquid are each pressurized to a pressure above atmospheric pressure.

8. The Stirling engine as claimed in claim 1 wherein the circuit includes an accumulator positioned upstream and downstream from a fluid driven motor.

9. The Stirling engine as claimed in claim 8 wherein the fluid driven motor has a rotary output.

10. The Stirling engine as claimed in claim 9 wherein the accumulators and the fluid driven motor provide a rotary output system which employs fluid seals and does not require gas seals.

11. The Stirling engine as claimed in claim 1 wherein the sealed region has a heating chamber and a cooling chamber and the a circuit includes a heat exchange portion exterior to the cooling chamber whereby the liquid is employed to remove heat from the cooling chamber.

12. The Stirling engine as claimed in claim 11 wherein the circuit includes an accumulator positioned upstream and downstream from a fluid driven motor and the heat exchange portion is part of a single flow line.

13. The Stirling engine as claimed in claim 1 wherein the circuit includes an accumulator positioned upstream and downstream from a fluid driven motor and a radiator is provided in the circuit to remove excess heat from the engine.

14. The Stirling engine as claimed in claim 13 wherein the radiator is positioned downstream of the reservoir.

15. A Stirling engine driven hydraulic pump in fluid flow communication with said Stirling engine, the hydraulic pump being driven by a periodic pulse produced by the Stirling engine wherein the periodic pulses cause a fluid to travel through a path that includes a reservoir and the hydraulic pump and the flow of fluid into the reservoir is axial and the flow of fluid out from the reservoir is tangential.

16. A Stirling engine driven hydraulic pump in fluid flow communication with said Stirling engine, the hydraulic pump being driven by a periodic pulse produced by the Stirling engine wherein the periodic pulses cause a fluid to travel through a path that includes a reservoir and the hydraulic pump and the flow of fluid into and out from the reservoir is tangential.

17. A Stirling engine driven hydraulic pump in fluid flow communication with said Stirling engine, the hydraulic pump being driven by a periodic pulse produced by the Stirling engine wherein the periodic pulses cause a fluid to travel through a path that includes a reservoir and the hydraulic pump and the flow of hydraulic fluid into the reservoir is tangential and the flow of hydraulic fluid out from the reservoir is axial.

18. The Stirling engine as claimed in claim 1 wherein the circuit comprises a fluid driven motor.

* * * * *